US009980579B2

(12) United States Patent
Walker et al.

(10) Patent No.: US 9,980,579 B2
(45) Date of Patent: May 29, 2018

(54) CHILD CARRYING UNITS

(71) Applicant: ICANDY WORLD LIMITED, Bedfordshire (GB)

(72) Inventors: Paul Andrew Walker, Hertfordshire (GB); Reuben John Miller, Liaobu Town Dongguan City (CN); Ma Lei, Liaobu Town Dongguan City (CN)

( * ) Notice: Subject to any disclaimer, the term of this patent is extended or adjusted under 35 U.S.C. 154(b) by 0 days. days.

(21) Appl. No.: 15/116,517

(22) PCT Filed: Feb. 3, 2015

(86) PCT No.: PCT/IB2015/050824

§ 371 (c)(1),
(2) Date: Aug. 4, 2016

(87) PCT Pub. No.: WO2015/118452

PCT Pub. Date: Aug. 13, 2015

(65) Prior Publication Data

US 2016/0345749 A1 Dec. 1, 2016

(30) Foreign Application Priority Data

Feb. 4, 2014 (GB) ..... 1401871.7

(51) Int. Cl.
*A47D 13/02* (2006.01)

(52) U.S. Cl.
CPC ..... *A47D 13/02* (2013.01)

(58) Field of Classification Search
CPC ..... A47D 9/00; A47D 9/005; A47D 13/02; A47C 9/005
See application file for complete search history.

(56) References Cited

U.S. PATENT DOCUMENTS

| | | | | | |
|---|---|---|---|---|---|
| 2,551,509 | A * | 5/1951 | Smith | A47D 13/02 | 294/140 |
| 3,096,917 | A * | 7/1963 | Gudiksen | A47D 13/02 | 294/140 |
| 5,819,341 | A * | 10/1998 | Simantob | A47C 9/002 | 224/160 |
| D640,483 | S * | 6/2011 | Daley | A47D 9/005 | D6/333 |
| 2004/0148700 | A1* | 8/2004 | Brereton | A47D 7/002 | 5/102 |
| 2005/0060805 | A1* | 3/2005 | Chen | A47D 9/00 | 5/617 |
| 2007/0006910 | A1* | 1/2007 | Chu | A47D 9/005 | 135/133 |
| 2014/0084032 | A1* | 3/2014 | Duan | A47D 13/02 | 224/158 |

FOREIGN PATENT DOCUMENTS

| | | | | |
|---|---|---|---|---|
| EP | 1493361 | A1 * | 1/2005 | A47D 9/005 |
| WO | WO-2008028597 | A1 * | 3/2008 | A47D 9/005 |

* cited by examiner

*Primary Examiner* — Eric J Kurilla
(74) *Attorney, Agent, or Firm* — The Weintraub Group, P.L.C.

(57) ABSTRACT

A child carrying unit (4) comprising a base portion (6) and a wall portion (8) substantially surrounding the base portion (6), the wall portion (8) comprises first and second pliable members, which meet end-to-end at a jointed region, the arrangement being such that at least a portion of one part of the child carrying unit (4) including one of the pliable members is locatable in an opposite part by way of the jointed region in the wall portion (8).

11 Claims, 6 Drawing Sheets

CHILD CARRYING UNITS

This invention relates to a child carrying unit, and in particular to a so-called carry-cot for infants and relatively young children.

In relation to manufacturing such child-carrying units, one of the biggest concerns for manufacturers is the volumetric space a unit occupies, owing to the fact that the cost of transporting from a place of manufacture to a place of sale increases as the volumetric space of an article increases and that price is naturally passed onto the end consumer. As a consequence, the storage space an end user requires to store the unit when not in use, such as in the boot or trunk of a motor vehicle, is also an important factor for end users to consider when purchasing such a unit.

According to one aspect of the present invention, there is provided a child carrying unit comprising a base portion and a wall portion substantially surrounding the base portion, the wall portion comprises first and second pliable members, which meet end-to-end at a jointed region, the arrangement being such that at least a portion of one part of the child carrying unit including one of the pliable members is locatable in an opposite part by way of the jointed region in the wall portion.

According to a second aspect of the present invention, there is provided a method comprising manipulating a child carrying unit, having a base portion and a wall portion substantially surrounding the base portion, about a jointed region in the wall portion, collapsing a first pliable member of the wall portion inwardly of the carrying unit such that an inwardly facing surface of one end region of the carrying unit including the first pliable member is brought alongside the inwardly facing part of the wall portion including a second pliable member and thereby locating at least a portion of one part of the child carrying unit into an opposite part.

Owing to these aspects, it is possible to provide a collapsible child carrying unit to occupy a relatively small volumetric space by being collapsible about a jointed region.

In a preferred embodiment, the base portion and the wall portion are of a flexible nature such that the carrying unit is collapsible about the jointed region to bring about a reduction in volumetric space in all three dimensions, namely length, width and height.

Preferably, the wall portion comprises a textile covering internally of which there are the first and second pliable members, which meet end-to-end to form the jointed region.

Advantageously, the first and second pliable members are substantially U-shaped and meet end-to-end at the jointed region which allows the folding of one end region of the carrying unit into the other. Advantageously, this location is at approximately half the length of the carrying unit such that the pliable members can be substantially identical to each other and in order to maximize the size reduction when collapsing the carrying unit.

Preferably, when the carrying unit is in an open configuration, i.e. not collapsed, a frame member is attachable to the top edge region of the wall portion in order to provide support to the structure of the carrying unit. Advantageously, the frame member is that of a seat unit of a pushchair which is removable from the pushchair frame and to which the carrying unit can be attached.

Furthermore, it is preferable that the top edge region of the wall portion comprises attaching means to attach the frame to the carrying unit.

Moreover, it is advantageous that a base panel be placed in association with the base portion to provide a firm and unyielding base upon which an infant can be safely supported. The base panel is relatively thin and substantially planar and is advantageously insertable into a pocket structure in the base portion.

A mattress may also be placed within the carrying unit upon the base portion to provide extra comfort if necessary. In addition, a cushioned surround to be placed around at least part of the internal surface of the wall portion may also be provided.

Preferably, a carrying unit in the form of a carry cot can be provided and which comprises at least the carrying unit, and the base panel, which are separate items and when the carrying unit is in a collapsed state, can be supplied in a flat-packed state and thus occupying a relatively small volumetric space.

In order that the present invention be clearly and completely disclosed, reference will now be made, by way of example, to the accompanying drawings in which.

Figure 1:
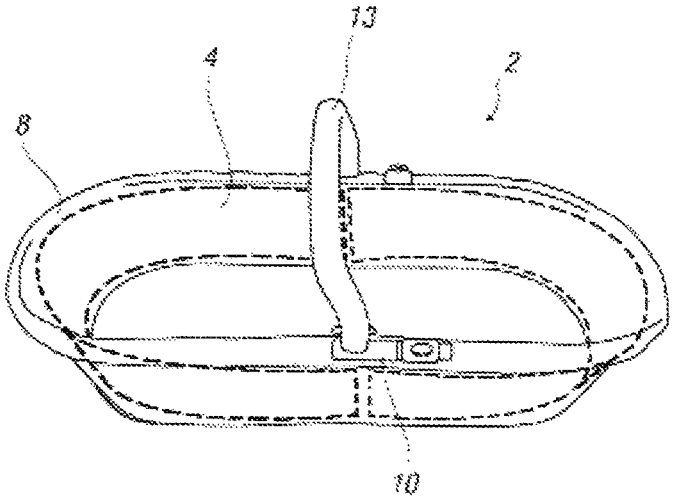
FIG. 1 is a perspective view from above of a carry cot.
Figure 2:
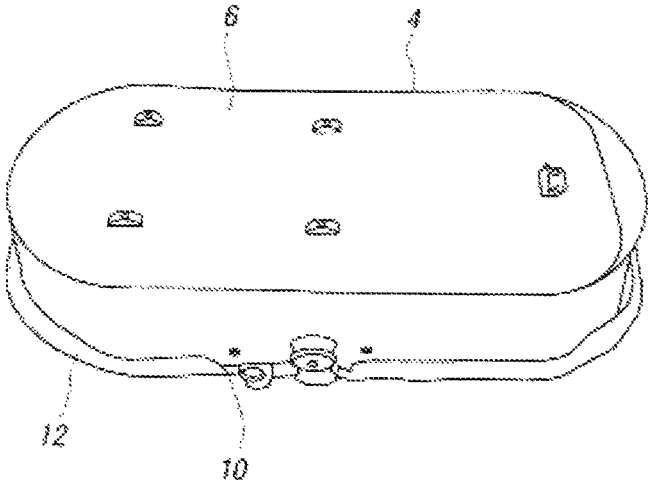
FIG. 2 is a perspective view from below of the carry cot of FIG. 1.
Figure 3:
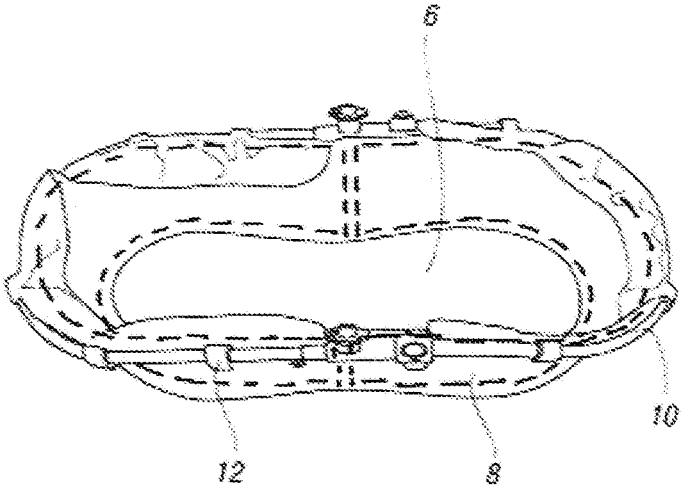
FIGS. 3 to 7 show a child carrying unit of the carry cot of FIG. 1 in progressive stages of being collapsed or folded.
Figure 4:
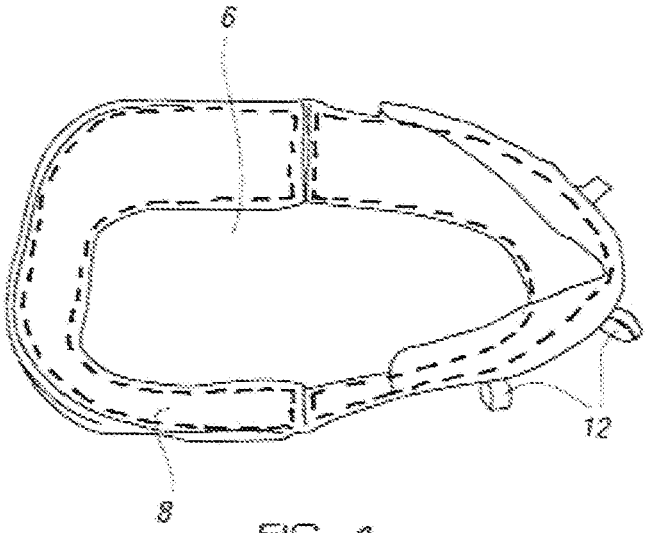
Figure 5:
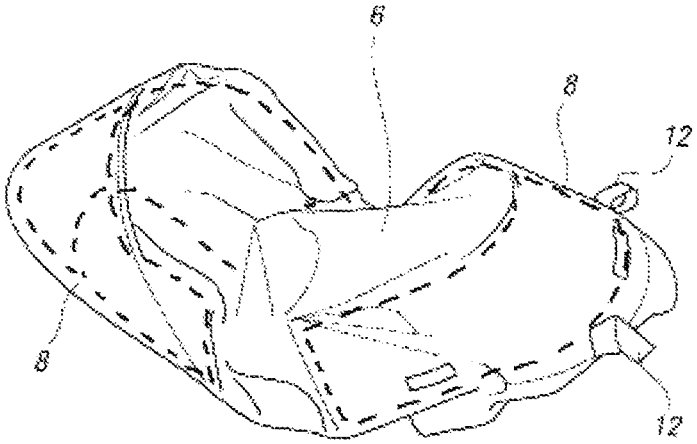
Figure 6:
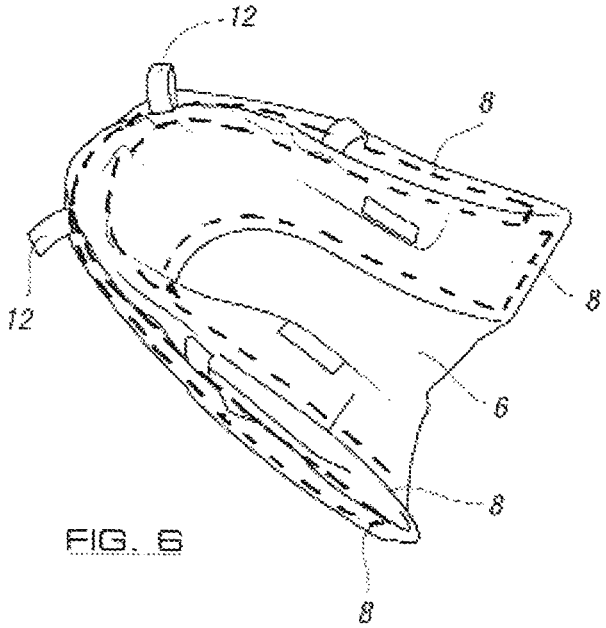
Figure 7:
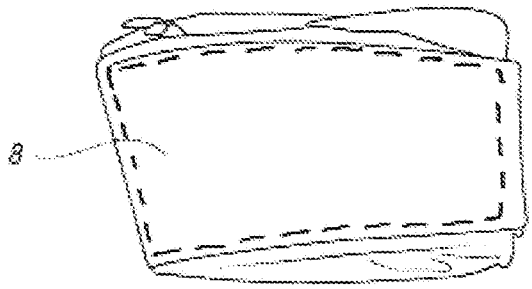

Referring to FIGS. 1 and 2, a carry cot 2 in an open or erected state comprises a child carrying unit 4 having a base portion 6 and a wall portion 8 substantially surrounding the base portion 6 and extending upwardly therefrom to a desired extent. The base portion 6 and the wall portion 8 are manufactured from a flexible material, such as a textile material, and internally of the wall portion 8 there are first and second substantially identical U-shaped pliable sheet members (shown in broken lines) that meet end-to-end in a substantially oval configuration to form a jointed region in a substantially vertical plane through the central region of the carrying unit 4. The pliable sheet members therefore substantially surround the base portion 6 and extend substantially the height of the wall portion 8 in order that they provide support for the wall portion 8 around the whole of the carry cot 2. The carry cot 2 also comprises a frame member 10 (see FIG. 8) attached to a top edge region of the carrying unit 4 by attaching means 12 in the form of, for example, Velcro (registered Trade Mark) flaps or straps or any other suitable means such as stud fasteners or a zip fastener. The frame member 10 is removable from the carrying unit 4 by way of the attaching means 12 and provides further support to the wall portion 8 around the circumference of the carry cot 2.

Figure 8:
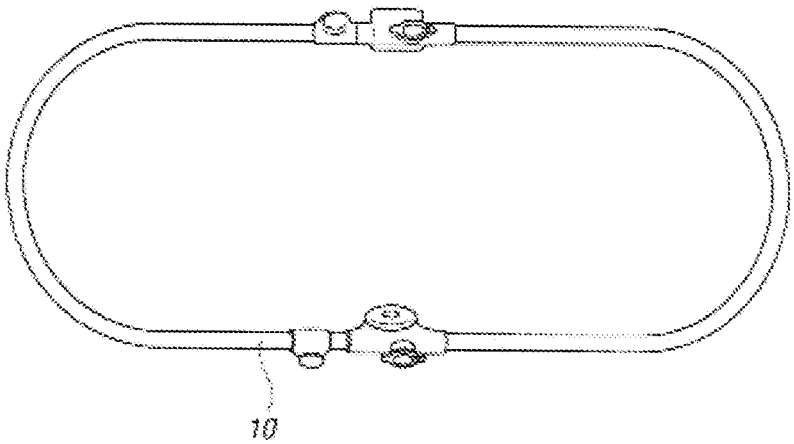
FIG. 8 shows a view from below of a frame member for the carry cot of FIG. 1.

The frame member 10, shown in FIG. 8, is advantageously a seat frame member from a pushchair seat unit already supplied with a pushchair (not shown) to which the carry cot 2 is thus also connectable by way of the frame member 10. The frame member 10 lies in a single plane, such that once removed from the carrying unit 4 it occupies a relatively small volumetric space. A bar member 13 may be detachably connected to the frame member 10 which is utilised as a carry handle for the carry cot 2.

Once the frame member 10 is removed from the carrying unit, the carrying unit 4 can be collapsed or folded such that the first pliable member can be manipulated to be folded inwardly of the carrying unit 4, i.e. it is inverted, such that the end region of the carrying unit 4 including the first pliable member can be manipulated such that the inwardly facing surface of that end region is brought closely alongside face-to-face with the inwardly facing part of the wall portion including the second pliable member. In this way, the substantially oval configuration is reduced to a substantially U-shaped configuration as one pliable member is inverted and folded about the jointed region in the substantially vertical plane to lie inside the other. Subsequently, owing to the flexibility of the first and second pliable members lying alongside each other, the U-shaped configuration can be compressed into a flattened state resulting in a reduction in the volumetric space of the carrying unit in terms of its length, its width and its height, i.e. an all three dimensions. This process of collapsing or folding is shown in different stages in FIGS. 3 to 7. In this way, the properties of the pliable sheet members are utilized to bring about relatively simple collapsing of the carry cot 2.

The jointed region between the first and second pliable members does not have to be approximately half-way along the length of the carrying unit 4 as shown, but it is preferable to maximize the reduction in the volumetric space.

Figure 9:
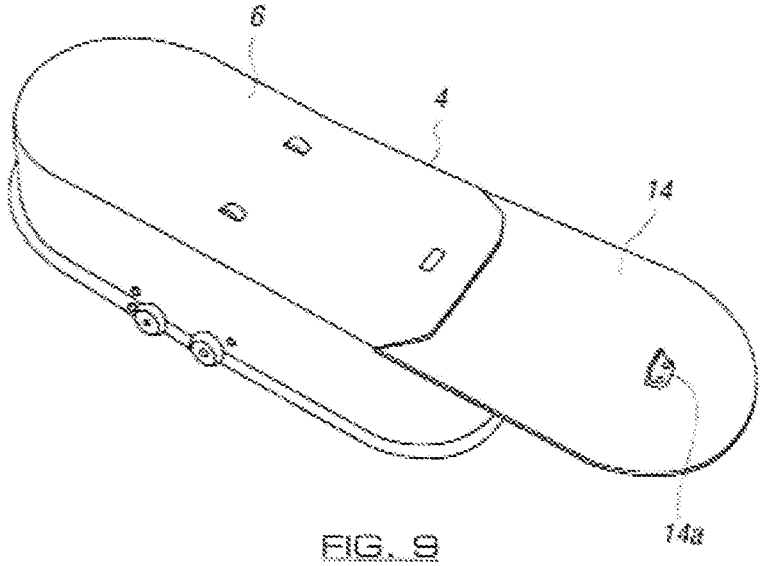
FIG. 9 is a similar view to FIG. 2, but with a base panel of the child carrying unit partially inserted.
Figure 10:
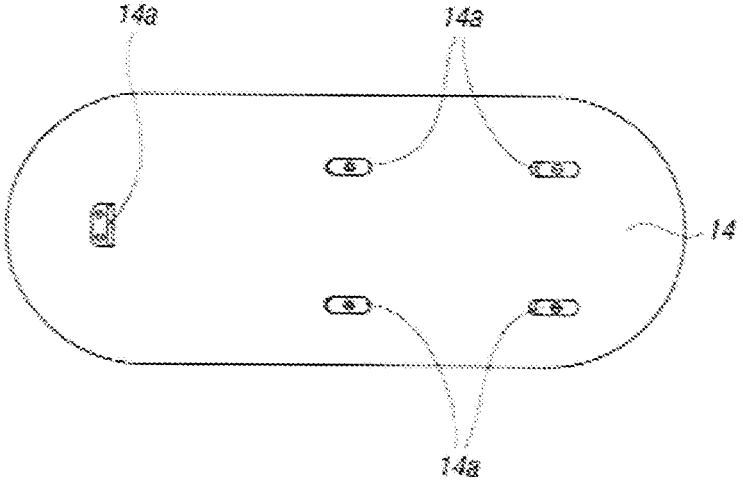
FIG. 10 shows a view from below of the base panel.

Referring to FIGS. 9 and 10, owing to the base portion 6 being of a flexible nature, a base panel 14 may also be provided. If an infant is to be placed in the carrying unit 4, then for safety reasons it is better to have an unyielding surface upon which to rest the infant inside the carrying unit. The base panel 14 is relatively thin and flat made from a plastics material and arranged to be placed in association with the base portion 6 to provide a firm surface upon which an infant can be safely placed. Advantageously, the base panel 14 is removably insertable into a pocket structure in the underside of the carrying unit such that it is hidden away and thus not easily tampered with. The base panel 14 may also include a plurality of feet portions 14*a* which, when inserted into the pocket, project through openings in underside of the base portion 6 to rest upon the ground or floor. A mattress 16 (see FIG. 11) may also be supplied with the carry cot 2 to provide extra comfort to the infant if necessary.

A cushioned article (not shown) may further be provided which surrounds at least part of the inside surface of the wall portion 8 facing the infant.

Figure 11:
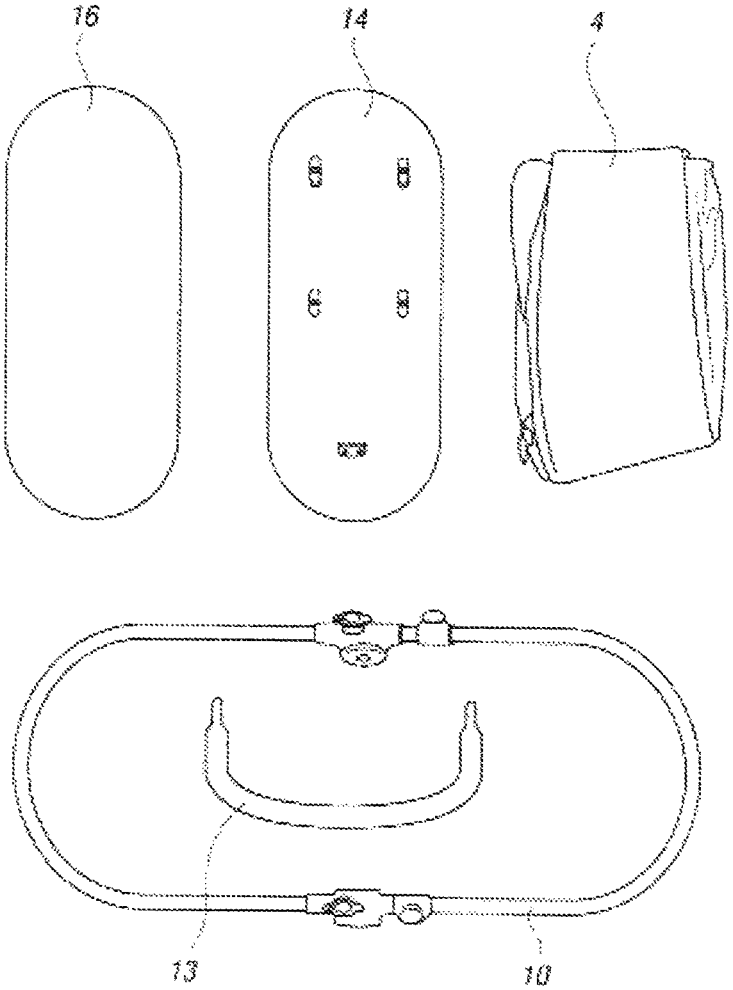
FIG. 11 shows a view of the individual component parts of the carry cot of FIG. 1.

Referring to FIG. 11, the carry cot is supplied to an end user in a disassembled, collapsed or folded state and, at the very least, would comprise the carrying unit 4 and the base panel 14, such that the volumetric space occupied by those items in a package to be shipped or to store would be relatively small. As a result, there are relatively significant storage benefits to the end user.

Even with the addition of the other items described herein, including the frame member 10 (if not utilizing the seat frame member from the pushchair), the bar member 13 and the mattress 16 the volumetric space required for shipping and storage would not increase a significant amount owing to the flatness of the individual parts in a disassembled state. In this way, the cost efficiency of shipping carry cots is significantly increased, which reduction in cost can thus be passed onto the end consumer, who also benefits in the reduction of storage space required.

The invention claimed is:

1. A child carrying unit comprising a base portion and a substantially oval wall portion substantially surrounding the base portion, the wall portion comprising first and second pliable members, which meet end-to-end at a jointed region, wherein at least a portion of one part of the child carrying unit including one of the pliable members is locatable in an opposite part by way of the jointed region in the wall portion, and further wherein the first and second pliable members are pliable sheet members, the first pliable sheet member being foldable inwardly of the carrying unit, such that in its inverted condition an end region of the carrying unit, including the first pliable sheet member, can be arranged such that the inwardly facing surface of that end region is brought closely alongside face-to-face with the inwardly facing part of the wall portion which includes the second pliable sheet member, so that the substantially oval wall portion is reduced to a substantially U-shaped configuration.

2. The child carrying unit according to claim 1, wherein the first and second pliable members are substantially U-shaped.

3. The child carrying unit according to claim 1 or 2, wherein the first and second pliable members meet end-to-end at approximately half the length of the carrying unit.

4. The child carrying unit according to claim 3, wherein the first and second pliable members are substantially identical to each other.

5. The child carrying unit according to any preceding claim, and further comprising a frame member attachable to the top edge region of the wall portion.

6. The child carrying unit according to claim 5, and further comprising attaching means at the top edge region of the wall portion to attach the frame member to the carrying unit.

7. The child carrying unit according to any preceding claim, and further comprising a base panel arranged to be placed in association with the base portion.

8. The child carrying unit according to claim 7, wherein the base panel is substantially planar and removably insertable into a pocket structure in the base portion.

9. A method comprising: (a) manipulating a child carrying unit, the unit having a base portion and a wall portion substantially surrounding the base portion, about a jointed region in the wall portion, (b) collapsing a first pliable sheet member of the wall portion inwardly of the carrying unit to invert it such that an inwardly facing surface of one end region of the carrying unit, including the first pliable sheet member, is brought alongside face-to-face with the inwardly facing part of the wall portion including a second pliable sheet member, thereby locating at least a portion of one part of the child carrying unit into an opposite part and (a) compressing the first and second pliable sheet members into a flattened state resulting in a reduction of the volumetric space of the carrying unit in all three dimensions.

10. The method according to claim 9, and further comprising: prior to said manipulating, removing a base panel from the base portion.

11. The method according to claim 9, and further comprising: prior to said manipulating, detaching a frame member from a top edge region of the wall portion.

* * * * *